US008648686B2

(12) United States Patent
Tsai et al.

(10) Patent No.: US 8,648,686 B2
(45) Date of Patent: Feb. 11, 2014

(54) RESONANT TRANSFORMER AND RESONANT CONVERTER EMPLOYING SAME

(75) Inventors: Hsin-Wei Tsai, Taoyuan Hsien (TW); Shih-Hsien Chang, Taoyuan Hsien (TW); Ching-Hsing Tien, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 59 days.

(21) Appl. No.: 13/347,841

(22) Filed: Jan. 11, 2012

(65) Prior Publication Data

US 2012/0106207 A1 May 3, 2012

Related U.S. Application Data

(63) Continuation-in-part of application No. 12/939,706, filed on Nov. 4, 2010, now abandoned.

(30) Foreign Application Priority Data

Nov. 5, 2009 (TW) ..... 98137637 A

(51) Int. Cl.
*H01F 27/30* (2006.01)

(52) U.S. Cl.
USPC ..... 336/198

(58) Field of Classification Search
USPC ..... 336/65, 83, 192, 196, 198, 200, 232
See application file for complete search history.

(56) References Cited

U.S. PATENT DOCUMENTS

| | | | | |
|---|---|---|---|---|
| 6,747,421 | B2 | 6/2004 | Kohn | |
| 7,365,501 | B2 | 4/2008 | Ushijima et al. | |
| 7,612,643 | B2 | 11/2009 | Hsu et al. | |
| 2002/0121955 | A1 | 9/2002 | Yeh et al. | |
| 2006/0006974 | A1 * | 1/2006 | Yang et al. | 336/208 |
| 2008/0012676 | A1 * | 1/2008 | Suzuki | 336/178 |

FOREIGN PATENT DOCUMENTS

| | | |
|---|---|---|
| CN | 1606106 | 4/2005 |
| CN | 2781530 Y | 5/2006 |
| CN | 101261895 | 9/2008 |
| TW | I253658 | 4/2006 |
| TW | 200611282 | 3/2007 |
| TW | M316482 | 8/2007 |
| TW | M327532 | 2/2008 |
| TW | 200425177 | 8/2009 |

* cited by examiner

*Primary Examiner* — Tuyen Nguyen
(74) *Attorney, Agent, or Firm* — Evan R. Witt; Kirton McConkie

(57) ABSTRACT

A resonant transformer and resonant converter are disclosed. The resonant transformer includes a first bobbin, a first primary winding coil, plural first secondary winding coils, a second bobbin, a second primary winding coil, plural second secondary winding coils and a magnetic core assembly. The first bobbin includes a first winding section and plural single-trough second winding sections. Plural pins are arranged at the first winding section. The first primary winding coil is wound around the first winding section and connected with the pins. The first secondary winding coils are wound around respective single-trough second winding sections. The second bobbin includes a third winding section and plural single-trough fourth winding sections. The second primary winding coil are wound around the third winding section and connected with the pins at the first winding section of the first bobbin. The second secondary winding coils are wound around respective single-trough fourth winding sections.

10 Claims, 7 Drawing Sheets

RESONANT TRANSFORMER AND RESONANT CONVERTER EMPLOYING SAME

CROSS-REFERENCE TO RELATED APPLICATION

This application is a continuation-in-part of U.S. patent application Ser. No. 12/939,706 filed on Nov. 4, 2010, and entitled "RESONANT TRANSFORMER". The entire disclosures of the above application are all incorporated herein by reference.

FIELD OF THE INVENTION

The present invention relates to a resonant transformer, and more particularly to a slim resonant transformer and a resonant converter employing the same.

BACKGROUND OF THE INVENTION

A transformer has become an essential electronic component for voltage regulation into required voltages for various kinds of electric appliances.

In the power supply system of the new-generation electric products such as LCD televisions, leakage inductance transformers (e.g. LLC transformers) become more and more prevailing. The use of the leakage inductance transformer may reduce damage possibility of the switch, minimize noise and enhance performance.

FIG. 1 is a schematic exploded view of a conventional leakage inductance transformer. As shown in FIG. 1, the transformer 1 comprises a bobbin 11, a covering member 12, and a magnetic core assembly 13. A primary winding coil 111 and a secondary winding coil 112 are wound around the bobbin 11. The output terminals 113, 114 of the primary and the secondary winding coils 111, 112 are directly wound and soldered on pins 115, which are perpendicularly extended from the bottom of the bobbin 11. The covering member 12 is used for partially sheltering the upper portion of the bobbin 11 in order to increase the creepage distances between the primary winding coil 111, the secondary winding coil 112 and the magnetic core assembly 13. The magnetic core assembly 13 includes middle portions 131 and leg portions 132. The middle portions 131 are accommodated within a channel 116 of the bobbin 11. The bobbin 11 is partially enclosed by the leg portions 132. Meanwhile, the transformer 1 is assembled.

Please refer to FIG. 1 again. After the covering member 12 is placed over the bobbin 11 to shelter the bobbin 11, the creepage distances between the primary winding coil 111, the secondary winding coil 112 and the magnetic core assembly 13 are increased. The use of the covering member 12, however, increases the overall height of the transformer 1. In addition, the required inductance is determined according to the turn numbers of the primary winding coil 111 and the secondary winding coil 112. If the diameter of the primary winding coil 111 or the secondary winding coil 112 is too large, the overall volume of the transformer 1 is increased as the turn numbers are increased. That is, it is difficult to minimize the conventional transformer 1.

In addition, after the transformer 1 is assembled, an air gap (not shown) is defined between the corresponding leg portions 132. The air gap is formed between the primary winding coil 111 and a secondary winding coil 112. If the secondary winding coil 112 is in a short-circuit condition, the magnetic path possibly causes individual loop. Under this circumstance, the leakage inductance of the transformer 1 fails to be stably controlled.

Due to that the bobbin 11 of the transformer 1 has only one single-trough first winding section for winding one primary winding coil 111 and one single-trough second winding section for winding one secondary winding coil 112, and the bobbin 11 has limited space for winding coils, and the turn numbers of the primary winding coil 111 and the secondary winding coil 112 are also limited. Therefore, the transformer 1 has a limited maximum power output of 100 Watts. When a power converter having a relatively high power output of 400 Watts is designed, four transformers 1 connected in series or in parallel must be employed in the power converter. It is obvious that the manufacturing cost of the power converter will be increased due to the usage of four set of bobbins 11 and four set of magnetic core assemblies 13 of the four transformers 1.

SUMMARY OF THE INVENTION

It is an object of the present invention to provide a resonant transformer and a resonant converter employing the same. The resonant transformer has plural single-trough second winding sections. Plural secondary winding coils are wound around respective single-trough second winding sections, so that the winding means and the magnetic path are changed and the manufacturing cost of the power converter having 4 times power output is reduced.

Another object of the present invention provides a resonant transformer and a resonant converter employing the same. The resonant transformer has an air gap disposed over the primary winding coil, thereby stably controlling the leakage inductance.

A further object of the present invention provides a resonant transformer and a resonant converter employing the same. The resonant transformer has increased winding space, enhanced electric conversion efficiency, and reduced heat generation.

A still object of the present invention provides a resonant transformer and a resonant converter employing the same. The resonant transformer has plural modular bobbins connected with each other in parallel, so that the output voltage of the resonant transformer is increased.

In accordance with an aspect of the present invention, there is provided a resonant transformer. The resonant transformer includes a first bobbin, a first primary winding coil, plural first secondary winding coils, a second bobbin, a second primary winding coil, plural second secondary winding coils, and a magnetic core assembly. The first bobbin includes a first main body and a first channel running through the first main body. The first main body includes a first winding section and plural single-trough second winding sections. Plural pins are arranged at the first winding section. The single-trough second winding sections are arranged at bilateral sides of the first winding section. The first primary winding coil is wound around the first winding section of the first bobbin, and connected with the pins at the first winding section. The first secondary winding coils are wound around respective single-trough second winding sections of the first bobbin. The second bobbin includes a second main body and a second channel running through the second main body. The second main body includes a third winding section and plural single-trough fourth winding sections. The single-trough fourth winding sections are arranged at bilateral sides of the third winding section. The second primary winding coil are wound around the third winding section of the second bobbin, and connected with the pins at the first winding section of the first bobbin. The second secondary winding coils are wound around respective single-trough fourth winding sections of the second bobbin. The magnetic core assembly is partially embedded into the first channel of the first bobbin and the second channel of the second bobbin.

In accordance with another aspect of the present invention, there is provided a resonant converter for converting an input voltage into an output voltage to drive a DC load. The resonant converter includes a switch circuit, a resonant circuit, a resonant transformer, a rectifier and a filter. The switch circuit is configured to receive the input voltage. The resonant circuit is connected with the switch circuit. The resonant transformer has an input winding connected with the resonant circuit and a plurality of output windings. The resonant transformer is configured to transfer the energy of the input voltage from the input winding to the output windings by a switching operation of the switch circuit and a resonance produced by the resonant circuit. The rectifier is connected with the output windings. The filter is connected with the rectifier for filtration so as to output the output voltage. The resonant transformer includes a first bobbin, a first primary winding coil, plural first secondary winding coils, a second bobbin, a second primary winding coil, plural second secondary winding coils, and a magnetic core assembly. The first bobbin includes a first main body and a first channel running through the first main body. The first main body includes a first winding section and plural single-trough second winding sections. Plural pins are arranged at the first winding section. The single-trough second winding sections are arranged at bilateral sides of the first winding section. The first primary winding coil is wound around the first winding section of the first bobbin, and connected with the pins at the first winding section. The first secondary winding coils are wound around respective single-trough second winding sections of the first bobbin. The second bobbin includes a second main body and a second channel running through the second main body. The second main body includes a third winding section and plural single-trough fourth winding sections. The single-trough fourth winding sections are arranged at bilateral sides of the third winding section. The second primary winding coil are wound around the third winding section of the second bobbin, and connected with the pins at the first winding section of the first bobbin so as to form the input winding. The second secondary winding coils are wound around respective single-trough fourth winding sections of the second bobbin and connected with the first secondary winding coils so as to form the output windings. The magnetic core assembly is partially embedded into the first channel of the first bobbin and the second channel of the second bobbin.

In accordance with another aspect of the present invention, there is provided a resonant transformer. The resonant transformer includes a bobbin, a primary winding coil, plural secondary winding coils, a covering member, and a magnetic core assembly. The bobbin includes a main body and a first channel running through the main body. The main body includes a first winding section and plural single-trough second winding sections. Plural pins are arranged at the first winding section. The single-trough second winding sections are arranged at bilateral sides of the first winding section. The primary winding coil is wound around the first winding section of the bobbin and connected with the pins. The secondary winding coils are wound around respective single-trough second winding sections of the bobbin. The covering member includes a second channel. The magnetic core assembly is partially embedded into the first channel of the bobbin and the second channel of the covering member.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 2:
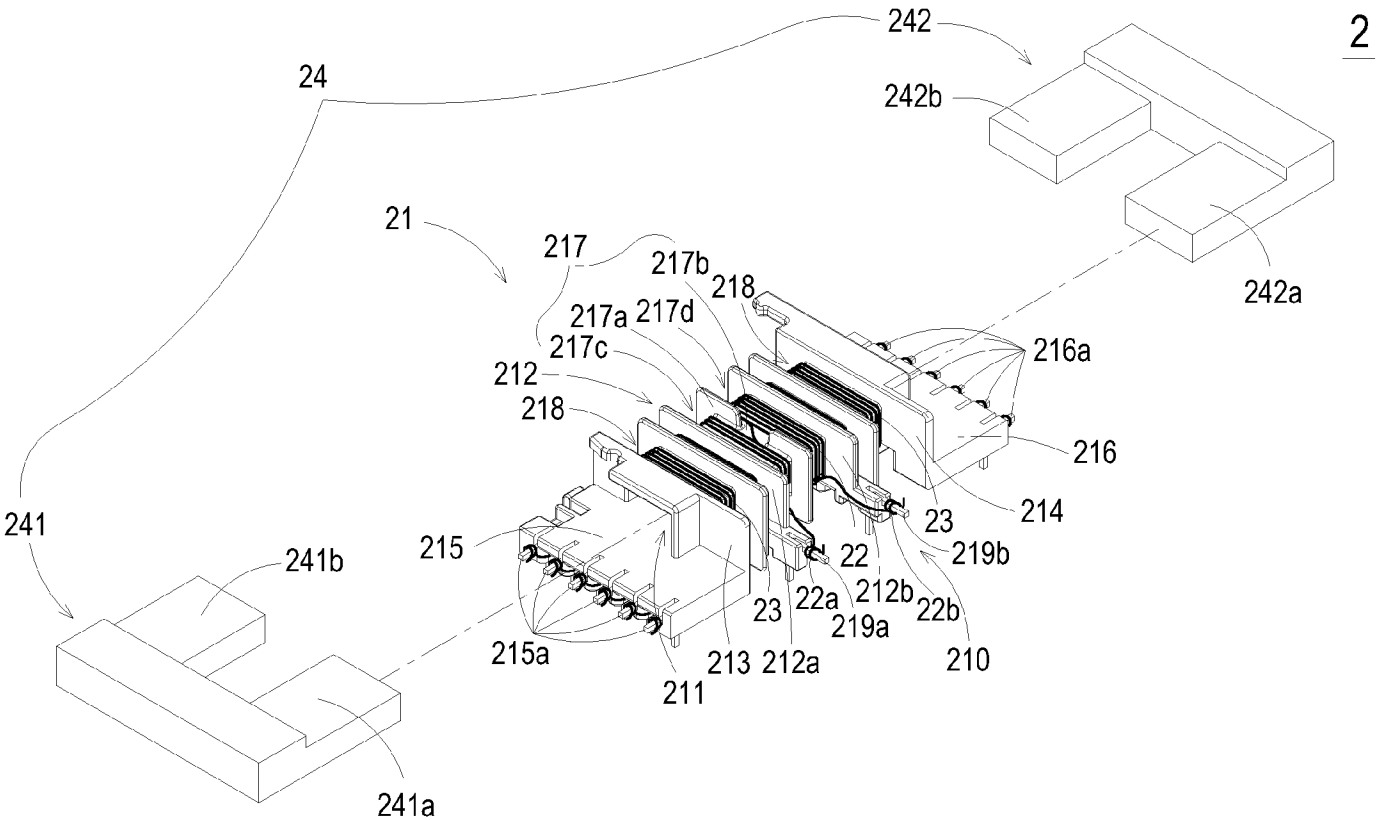
FIG. 2 is a schematic exploded view illustrating a resonant transformer according to a first embodiment of the present invention.

FIG. 2 is a schematic exploded view illustrating a resonant transformer according to a first embodiment of the present invention. As shown in FIG. 2, the resonant transformer 2 comprises a bobbin 21, a primary winding coil 22, plural secondary winding coils 23, and a magnetic core assembly 24.

The bobbin 21 comprises a main body 210, a channel 211, plural partition plates 212, a first side plate 213, a second side plate 214, a first connecting base 215 and a second connecting base 216. The channel 211 runs through the main body 210. The main body 210 is substantially cylinder tube with a rectangular cross-section. The first side plate 213 and the second side plate 214 are respectively arranged at two opposite sides of the main body 210. The partition plates 212 are disposed on the main body 210, and arranged between the first side plate 213 and the second side plate 214. In addition, the partition plates 212 are substantially parallel to the first side plate 213 and the second side plate 214. By the first side plate 213, the second side plate 214 and the partition plates 212, a first winding section 217 and plural single-trough second winding sections 218 are collectively defined on the main body 210. The first winding section 217 is disposed in the middle of the main body 220. The primary winding coil 22 is wound around the first winding section 217. The two partition plates 212*a* and 212*b* that define the first winding section 217 have a first pin 219*a* and a second pin 219*b*, respectively. The terminals of the primary winding coil 22 are fixed on the first pin 219*a* and the second pin 219*b*, so that the primary winding coil 22 is electrically connected to a circuit board (not shown). The single-trough second winding sections 218 are arranged at bilateral sides of the first winding section 217. The secondary winding coils 23 are wound around respective single-trough second winding sections 218. The first connecting base 215 and the second connecting base 216 are respectively extended from external surfaces of the first side plate 213 and the second side plate 214. Plural pins 215*a* and 216*a* are respectively extended from the first connecting base 215 and the second connecting base 216. Via the pins 215*a* and 216*a*, the secondary winding coils 23 are electrically connected with the circuit board.

In this embodiment, the bobbin 21 further comprises a central separation plate 217*a*. The central separation plate 217*a* is arranged in the first winding section 217. By the central separation plate 217*a*, the first winding section 217 is divided into a first portion 217*c* and a second portion 217*d*, so that the first winding section 217 is a multi-trough winding section. In addition, the central separation plate 217*a* further includes a notch 217*b*. During the procedure of winding the primary winding coil 22 around the first winding section 217, the primary winding coil 22 could be wound from the first portion 217*c* to the second portion 217*d* (or from the second portion 217*d* to the first portion 217*c*) through the notch 217*b*. In some embodiments, the central separation plate 217*a* is omitted, so that the first winding section 217 is also a single-trough winding section.

In this embodiment, the resonant transformer 2 has two single-trough second winding sections 218, which are arranged at bilateral sides of the first winding section 217. That is, two secondary winding coils 23 are respectively wound around the two single-trough second winding sections 218. Moreover, the two secondary winding coils 23 are connected to each other in parallel. As such, the turn number of each secondary winding coil 23 could be reduced while the total turn number is kept unchanged. Since the volume occupied by the secondary winding coils 23 is reduced, the overall volume of the resonant transformer 2 is reduced to achieve the purpose of minimization. It is noted that the number of the single-trough second winding sections 218 could be varied as required. For example, in some embodiments, the bobbin 21 has four single-trough second winding sections 218.

Please refer to FIG. 2 again. In this embodiment, the primary winding coil 22 is a conductive wire that is wound around the first winding section 217 of the main body 210. The primary winding coil 22 has two terminals 22*a* and 22*b*. For winding the primary winding coil 22, the primary winding coil 22 is firstly wound around the first portion 217*c* of the first winding section 217 and then wound around the second portion 217*d* through the notch 217*b* of the central separation plate 217*a*. Then, the terminal 22*a* of the primary winding coil 22 is wound around and soldered on the first pin 219*a* of the partition plate 212*a* (beside the first portion 217*c*), and the terminal 22*b* of the primary winding coil 22 is wound around and soldered on the second pin 219*b* of the partition plate 212*b* (beside the second portion 217*d*). Since the terminals 22*a* and 22*b* of the primary winding coil 22 are wound around the first pin 219*a* and the second pin 219*b*, the winding space of the first winding section 217 is increased. In other words, since the turn number of the primary winding coil 22 wound around the first winding section 217 is increased, the electric conversion efficiency is enhanced. In addition, the heat generated during operation of the transformer 2 is reduced.

It is noted that the winding direction of the primary winding coil 22 could be varied as required. In some embodiments, the terminal 22*b* is firstly wound around the second portion 217*d* of the first winding section 217 and then wound around the first portion 217*c* through the notch 217*b* of the central separation plate 217*a*. The secondary winding coils 23 are wound around respective single-trough second winding sections 218. That is, each secondary winding coil 23 is wound around a corresponding single-trough second winding section 218. The two terminals of each secondary winding coil 23 are soldered on the pins 215*a* and 216*a* that are respectively extended from the first connecting base 215 and the second connecting base 216.

Please refer to FIG. 2 again. The magnetic core assembly 24 comprises a first magnetic part 241 and a second magnetic part 242. The first magnetic part 241 of the magnetic core assembly 24 comprises a first leg portion 241*a* and a second leg portion 241*b*. The second magnetic part 242 of the magnetic core assembly 24 also comprises a first leg portion 242*a* and a second leg portion 242*b*. The first leg portions 241*a* and 242*a* are aligned with the channel 211 of the bobbin 21. After the first leg portions 241*a* and 242*a* are embedded into the channel 211 of the bobbin 21, the first magnetic part 241, the second magnetic part 242 and the bobbin 21 are combined together to assemble the resonant transformer 2. As such, the second leg portions 241*b* and 242*b* are disposed beside the bobbin 21. In this embodiment, the first magnetic part 241 and the second magnetic part 242 are U cores, so that the magnetic core assembly 24 is a UU-type magnetic core assembly. Alternatively, the first magnetic part 241 and the second magnetic part 242 of the magnetic core assembly 24 collectively define an EE-type magnetic core assembly. Since the air gap (not shown) between the second leg portions 241*b* and 242*b* is over the primary winding coil 22, the leakage inductance of the transformer 2 is not influenced by the air gap. By adjusting the distance between the primary winding coil 22 and secondary winding coil 23 or increasing the turn numbers of the winding coils, the leakage inductance of the transformer 2 could be stably controlled.

Figure 3A:
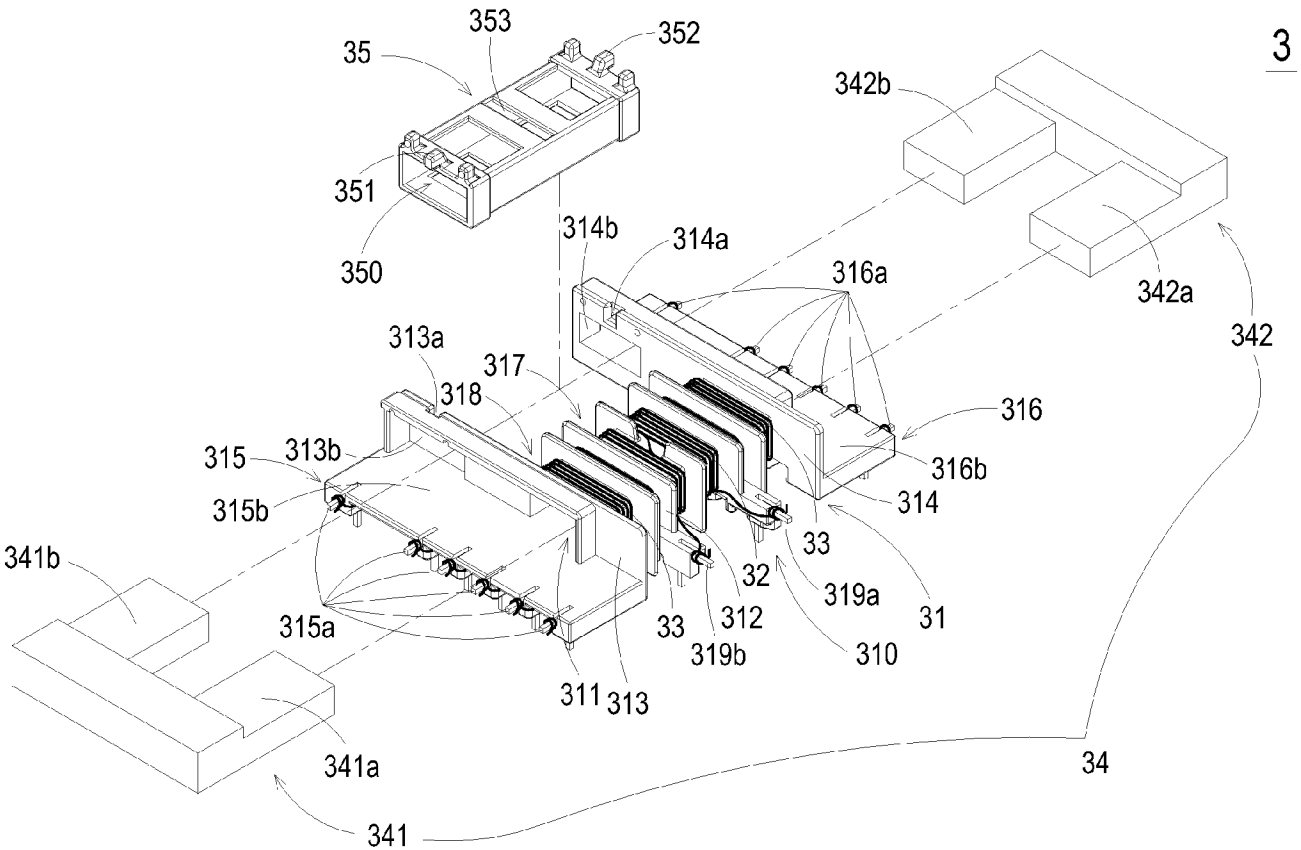
FIG. 3A is a schematic exploded view illustrating a resonant transformer according to a second embodiment of the present invention.

FIG. 3A is a schematic exploded view illustrating a resonant transformer according to a second embodiment of the present invention. As shown in FIG. 3A, the resonant transformer 3 comprises a bobbin 31, a primary winding coil 32, plural secondary winding coils 33, and a magnetic core assembly 34.

The bobbin 31 comprises a main body 310, a first channel 311, plural partition plates 312, a first side plate 313, a second side plate 314, a first connecting base 315 and a second connecting base 316. By the first side plate 313, the second side plate 314 and the partition plates 312, a first winding section 317 and plural single-trough second winding sections 318 are collectively defined on the main body 310. The magnetic core assembly 34 comprises a first magnetic part 341 and a second magnetic part 342. The first magnetic part 341 of the magnetic core assembly 34 comprises a first leg portion 341*a* and a second leg portion 341*b*. The second magnetic part 342 of the magnetic core assembly 34 also comprises a first leg portion 342*a* and a second leg portion 342*b*. The bobbin 31 further comprises a first pin 319*a*, a second pin 319*b*, and pins 315*a*, 316*a*. The configurations and functions of the main body 310, the first channel 311, the partition plates 312, the first side plate 313, a second side plate 314, the first connecting base 315, the second connecting base 316, the first pin 319*a*, the second pin 319*b* and the pins 315*a*, 316*a* of the bobbin 31, the primary winding coil 32, the secondary winding coils 33 and the magnetic core assembly 34 are similar to those described in FIG. 2, and are not redundantly described herein. In comparison with the transformer 2 of FIG. 2, the first side plate 313, the second side plate 314, the first connecting base 315 and the second connecting base 316 are respectively longer than the first side plate 213, the second side plate 214, the first connecting base 215 and the second connecting base 216. The first side plate 313, the second side plate 314, the first connecting base 315 and the second connecting base 316 are substantially perpendicular to the main body 310. Moreover, the first side plate 313 and the second side plate 314 have a first coupling part 313*a* and a second coupling part 314*a*, respectively. In this embodiment, the first coupling part 313*a* and the second coupling part 314*a* are concave structures formed in the upper edges of the first side plate 313 and the second side plate 314, respectively. Moreover, the first side plate 313 and the second side plate 314 have a first opening 313*b* and a second opening 314*b*, which are respectively aligned with the second leg portions 341*b* and 342*b*.

Please refer to FIG. 3A again. The resonant transformer 3 further comprises a covering member 35. The covering member 35 is a rectangular case having a second channel 350. The both ends of the second channel 350 are aligned with the first opening 313*b* of the first side plate 313 and the second opening 314*b* of the second side plate 314. In addition, corresponding to the first coupling part 313*a* and the second coupling part 314*a*, the covering member 35 further comprises a third coupling part 351 and a fourth coupling part 352, respectively. When the third coupling part 351 and the fourth coupling part 352 are respectively engaged with the first coupling part 313*a* and the second coupling part 314*a*, the covering member 35 and the bobbin 31 are combined together. In this embodiment, the third coupling part 351 and the fourth coupling part 352 are convex structures.

Figure 3B:
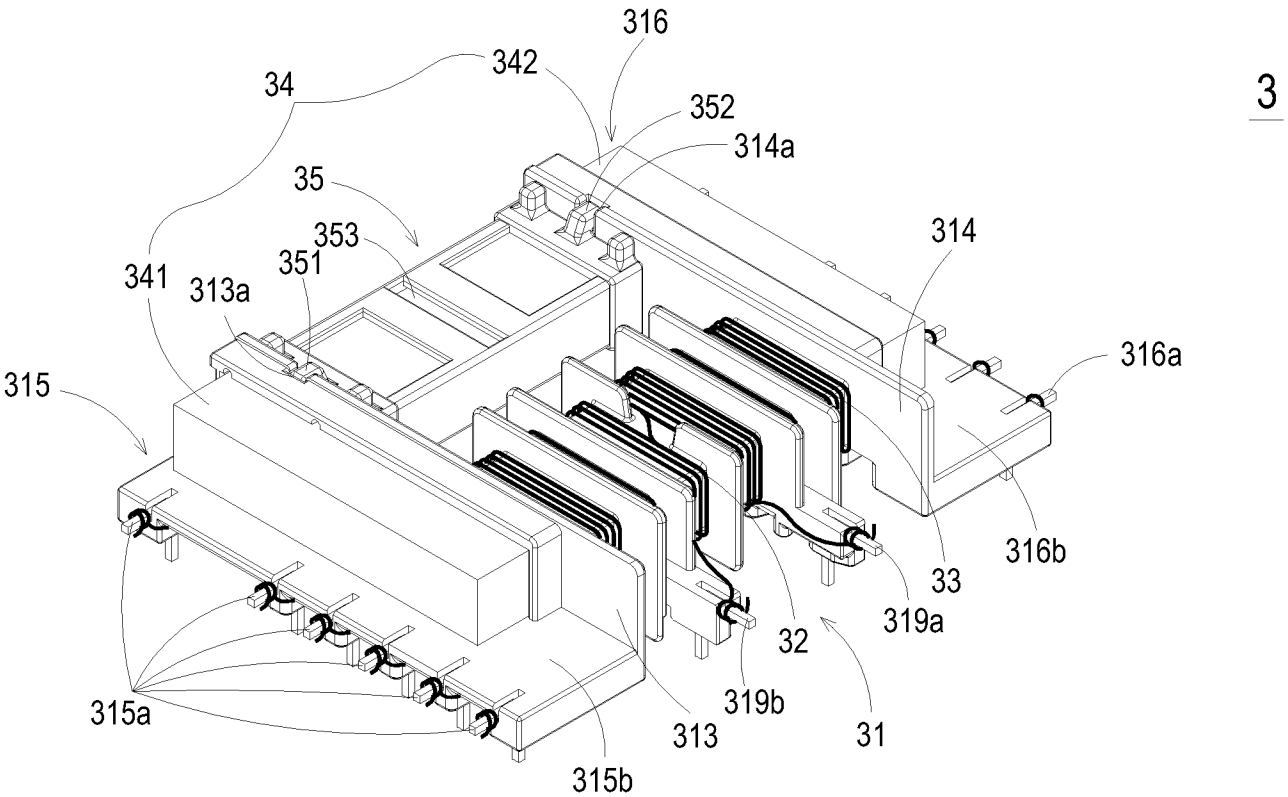
FIG. 3B is a schematic assembled view illustrating the resonant transformer of FIG. 3A.

FIG. 3B is a schematic assembled view illustrating the resonant transformer of FIG. 3A. Hereinafter, a process of assembling the resonant transformer 3 will be illustrated with reference to FIGS. 3A and 3B. First of all, the covering member 35 is placed between the extension parts of the first side plate 313 and the second side plate 314 of the bobbin 31. Then, the third coupling part 351 and the fourth coupling part 352 are respectively engaged with the first coupling part 313*a* and the second coupling part 314*a*, so that the covering member 35 and the bobbin 31 are combined together. Meanwhile, the first opening 313*b* of the first side plate 313 and the second opening 314*b* of the second side plate 314 are in communication with the second channel 350 of the covering member 35. Then, the first leg portion 341*a* of the first magnetic part 341 and the first leg portion 342*a* of the second magnetic part 342 are embedded into the first channel 311 of the bobbin 31, and the second leg portions 341*b* and 342*b* are respectively penetrated through the openings 313*b* and 314*b* and embedded into the second channel 350 of the covering member 35. At the same time, the first magnetic part 341 and the second magnetic part 342 that are exposed outside the bobbin 31 are supported on the first surface 315*b* of the first connecting base 315 and the second surface 316*b* of the second connecting base 316. The resulting structure of the transformer 3 is shown in FIG. 3B. Since the primary winding coil 32 and the secondary winding coils 33 wound around the bobbin 31 are separated from the magnetic core assembly 34 by the covering member 35, the safety distance of the transformer 3 is maintained. In some embodiments, the covering member 35 further includes a hollow portion 353. A partition plate (not shown) is arranged in the hollow portion 353. The second leg portions 341*b* and 342*b* are separated by the partition plate in order to maintain the safety distance. It is noted that, however, those skilled in the art will readily observe that numerous modifications and alterations of the covering member 35 may be made while retaining the teachings of the invention.

Figure 4A:
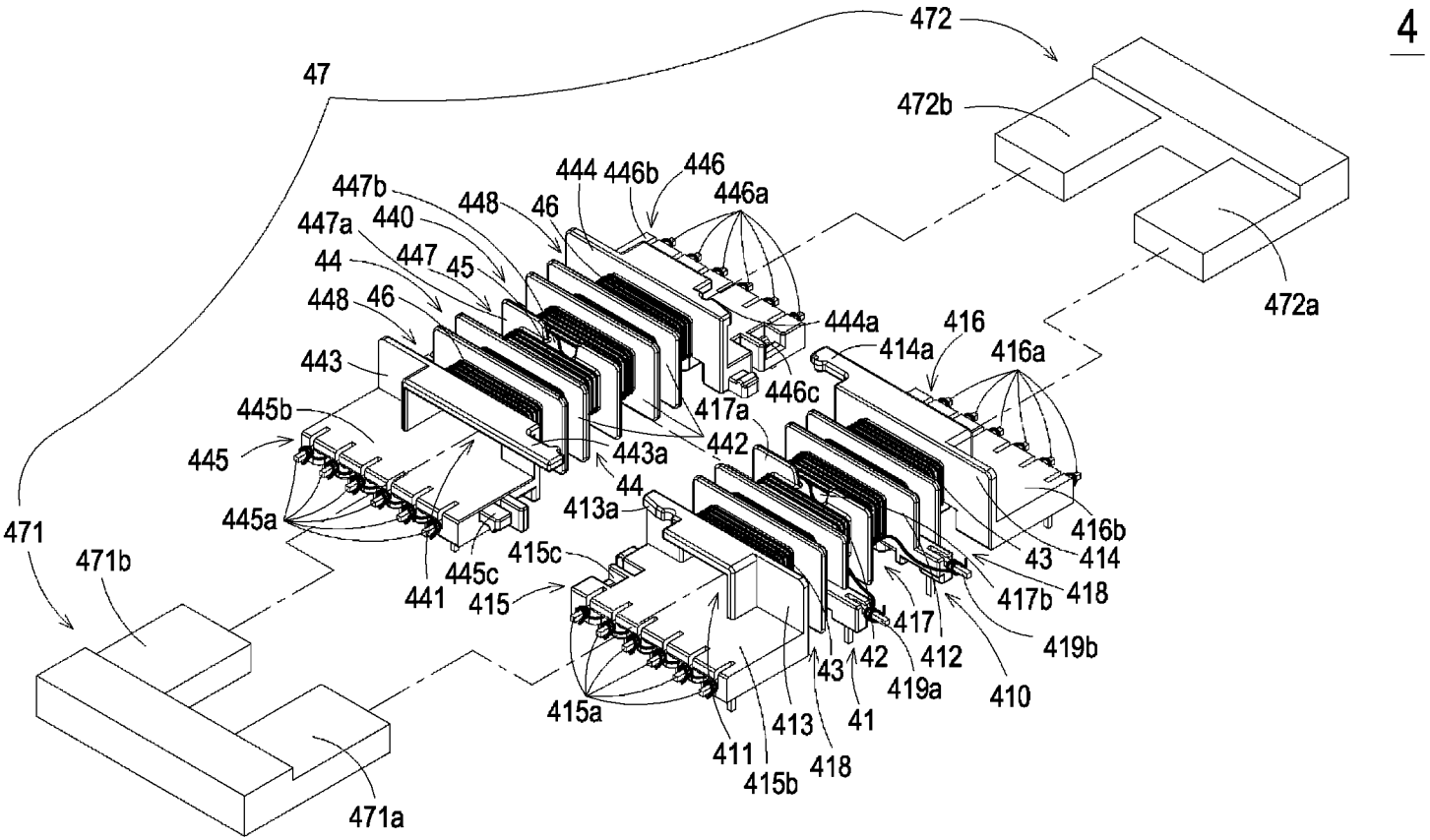
FIG. 4A is a schematic exploded view illustrating a resonant transformer according to a third embodiment of the present invention.

FIG. 4A is a schematic exploded view illustrating a resonant transformer according to a third embodiment of the present invention. As shown in FIG. 4A, the resonant transformer 4 comprises a first bobbin 41, a first primary winding coil 42, plural first secondary winding coils 43, a second bobbin 44, a second primary winding coil 45, plural second secondary winding coils 46, and a magnetic core assembly 47.

The first bobbin 41 comprises a first main body 410, a first channel 411, plural partition plates 412, a first side plate 413, a second side plate 414, a first connecting base 415 and a second connecting base 416. By the first side plate 413, the second side plate 414 and the partition plates 412, a first winding section 417 and plural single-trough second winding sections 418 are collectively defined on the first main body 410. The second bobbin 44 comprises a second main body 440, a second channel 441, plural partition plates 442, a third side plate 443, a fourth side plate 444, a third connecting base 445 and a fourth connecting base 446. By the third side plate 443, the fourth side plate 444 and the partition plates 442, a third winding section 447 and plural single-trough fourth winding sections 448 are collectively defined on the second main body 440.

The first channel 411 and the second channel 441 run through the first main body 410 and the second main body 440, respectively. The first main body 410 and the second main body 440 are substantially cylinder tubes with rectangular cross-sections. The first side plate 413 and the second side plate 414 are respectively arranged at two opposite sides of the first main body 410. The third side plate 443 and the fourth side plate 444 are respectively arranged at two opposite sides of the second main body 440. The partition plates 412 are disposed on the first main body 410, and arranged between the first side plate 413 and the second side plate 414. In addition, the partition plates 412 are substantially parallel to the first side plate 413 and the second side plate 414. The partition plates 442 are disposed on the second main body 440, and arranged between the third side plate 443 and the fourth side plate 444. In addition, the partition plates 442 are substantially parallel to the third side plate 443 and the fourth side plate 444. By the first side plate 413, the second side plate 414 and the partition plates 412, a first winding section 417 and plural single-trough second winding sections 418 are collectively defined on the first main body 410. By the third side plate 443, the fourth side plate 444 and the partition plates 442, a third winding section 447 and plural single-trough fourth winding sections 448 are collectively defined on the second main body 440. The first winding section 417 and the third winding section 447 are disposed in the middles of the first main body 420 and the second main body 440, respectively.

The first primary winding coil 42 and the second primary winding coil 45 are wound around the first winding section 417 and the third winding section 447. The two partition plates 412 that define the first winding section 417 have a first pin 419*a* and a second pin 419*b*, respectively. The terminals of the first primary winding coil 42 and the second primary winding coil 45 are fixed on the first pin 419*a* and the second pin 419*b*, so that the first primary winding coil 42 and the second primary winding coil 45 are electrically connected to a circuit board (not shown). The single-trough second winding sections 418 are arranged at bilateral sides of the first winding section 417, and the single-trough fourth winding sections 448 are arranged at bilateral sides of the third winding section 447. The first secondary winding coils 43 are wound around respective single-trough second winding sections 418, and the second secondary winding coils 46 are wound around respective single-trough fourth winding sections 448.

The first connecting base 415 and the second connecting base 416 are respectively extended from external surfaces of the first side plate 413 and the second side plate 414. Plural pins 415*a* and 416*a* are respectively extended from the first connecting base 415 and the second connecting base 416. Via the pins 415*a* and 416*a*, the first secondary winding coils 43 are electrically connected with the circuit board. Similarly, the third connecting base 445 and the fourth connecting base 446 are respectively extended from external surfaces of the third side plate 443 and the fourth side plate 444. Plural pins 445*a* and 446*a* are respectively extended from the third connecting base 445 and the fourth connecting base 446. Via the pins 445*a* and 446*a*, the second secondary winding coils 46 are electrically connected with the circuit board.

In this embodiment, the first bobbin 41 and the second bobbin 44 further comprise central separation plates 417*a*, 447*a*, respectively. The central separation plates 417*a*, 447*a* are arranged in the first winding section 417 and the third winding section 447, respectively. By the central separation plate 417*a*, the first winding section 417 is divided into two portions so that the first winding section 417 is a multi-trough winding section. By the central separation plate 447*a*, the third winding section 447 is divided into two portions so that the third winding section 447 is a multi-trough winding section. In addition, the central separation plate 417*a* further includes a notch 417*b*. During the procedure of winding the first primary winding coil 42 around the first winding section 417, the first primary winding coil 42 could be wound from the one portion to another portion through the notch 417*b*. The central separation plate 447*a* further includes a notch 447*b*. During the procedure of winding the second primary winding coil 45 around the third winding section 447, the second primary winding coil 45 could be wound from the one portion to another portion through the notch 447*b*. In some embodiments, the central separation plates 417*a*, 447*a* are omitted, so that the first winding section 417 and the second winding section 447 are also single-trough winding sections.

In this embodiment, the resonant transformer 4 has two single-trough second winding sections 418, which are arranged at bilateral sides of the first winding section 417. That is, two first secondary winding coils 43 are respectively wound around the two single-trough second winding sections 418. Moreover, the two first secondary winding coils 43 are connected to each other in parallel. The resonant transformer 4 has two single-trough fourth winding sections 448, which are arranged at bilateral sides of the third winding section 447. That is, two second secondary winding coils 46 are respectively wound around the two single-trough fourth winding sections 448. Moreover, the two second secondary winding coils 46 are connected to each other in parallel. As such, the turn number of each first secondary winding coil 43 and second secondary winding coil 46 could be reduced while the total turn number is kept unchanged. Since the volume occupied by the first secondary winding coils 43 and the second secondary winding coils 46 are reduced, the overall volume of the resonant transformer 4 is reduced to achieve the purpose of minimization. It is noted that the number of the single-trough second winding sections 418 and the single-trough fourth winding sections 448 could be varied as required. For example, in some embodiments, the first bobbin 41 has four single-trough second winding sections 418 and the second bobbin 44 has four single-trough second winding sections 448.

Figure 4B:
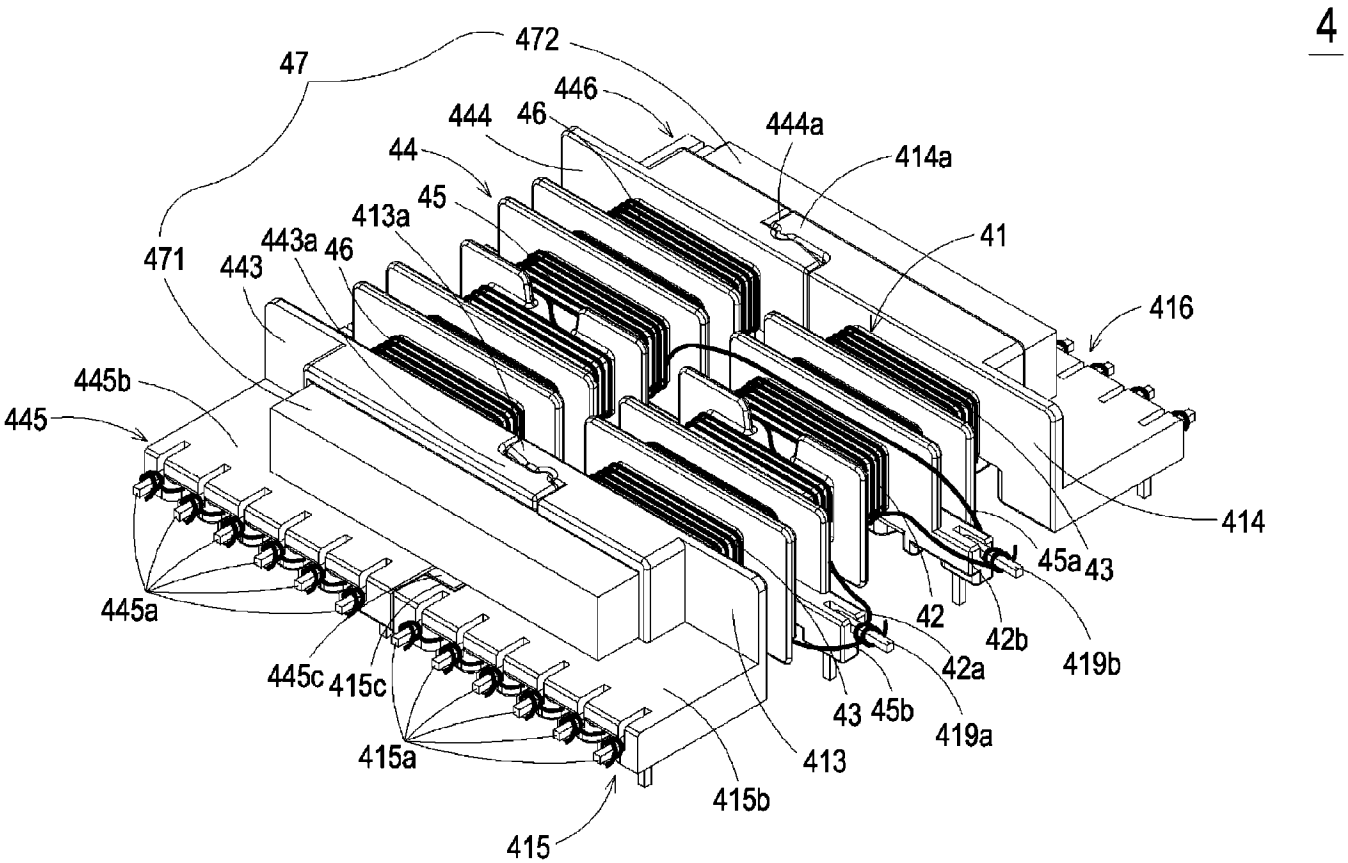
FIG. 4B is a schematic assembled view illustrating the resonant transformer of FIG. 4A.

FIG. 4B is a schematic assembled view illustrating the resonant transformer of FIG. 4A. Please refer to FIGS. 4A and 4B. The first primary winding coil 42 is a conductive wire that is wound around the first winding section 417 of the first main body 410, and the first primary winding coil 42 has two terminals 42*a* and 42*b*. The second primary winding coil 45 is a conductive wire that is wound around the third winding section 447 of the second main body 440, and the second primary winding coil 45 has two terminals 45*a* and 45*b*. For winding the first primary winding coil 42, the first primary winding coil 42 is firstly wound around the first portion of the first winding section 417 and then wound around the second portion of the first winding section 417 through the notch 417*b* of the central separation plate 417*a*. Then, the terminal 42*a* of the first primary winding coil 42 is wound around and soldered on the first pin 419*a*, and the terminal 42*b* of the first primary winding coil 42 is wound around and soldered on the second pin 419*b*. Similarly, for winding the second primary winding coil 45, the second primary winding coil 45 is firstly wound around the first portion of the third winding section 447 and then wound around the second portion of the third winding section 447 through the notch 447*b* of the central separation plate 447*a*. Then, the terminal 45*a* of the second primary winding coil 45 is wound around and soldered on the second pin 419*b*, and the terminal 45*b* of the second primary winding coil 45 is wound around and soldered on the first pin 419*a*. Since the terminals 42*a* and 42*b* of the first primary winding coil 42 and the terminals 45*b* and 45*a* of the second primary winding coil 45 are wound around the first pin 419*a* and the second pin 419*b*, the winding space of the first winding section 417 and the third winding section 447 are increased. In other words, since the turn number of the first primary winding coil 42 wound around the first winding section 417 and the turn number of the second primary winding coil 45 wound around the third winding section 447 are increased, the electric conversion efficiency is enhanced. In addition, the heat generated during operation of the resonant transformer 4 is reduced.

The first secondary winding coils 43 are wound around respective single-trough second winding sections 418. That is, each first secondary winding coil 43 is wound around a corresponding single-trough second winding section 418. The two terminals of each first secondary winding coil 43 are soldered on the pins 415*a* and 416*a* that are respectively extended from the first connecting base 415 and the second connecting base 416. Similarly, the second secondary winding coils 46 are wound around respective single-trough fourth winding sections 448. That is, each second secondary winding coil 46 is wound around a corresponding single-trough fourth winding section 448. The two terminals of each second secondary winding coil 46 are soldered on the pins 445*a* and 446*a* that are respectively extended from the third connecting base 445 and the fourth connecting base 446.

The magnetic core assembly 47 comprises a first magnetic part 471 and a second magnetic part 472. The first magnetic part 471 of the magnetic core assembly 47 comprises a first leg portion 471*a* and a second leg portion 471*b*. The second magnetic part 472 of the magnetic core assembly 47 also comprises a first leg portion 472*a* and a second leg portion 472*b*. The first leg portions 471*a* and 472*a* are aligned with the first channel 411 of the first bobbin 41, and the second leg portions 471*b* and 472*b* are aligned with the second channel 441 of the second bobbin 44. After the first leg portions 471*a* and 472*a* are embedded into the first channel 411 of the first bobbin 41 and the second leg portions 471*b* and 472*b* are embedded into the second channel 441 of the second bobbin 44, the first magnetic part 471, the second magnetic part 472, the first bobbin 41 and the second bobbin 44 are combined together to assemble the resonant transformer 4. In this embodiment, the first magnetic part 471 and the second magnetic part 472 are U cores, so that the magnetic core assembly 47 is a UU-type magnetic core assembly. But in some embodiments, the first magnetic part 471 and the second magnetic part 472 of the magnetic core assembly 47 may collectively define an EE-type magnetic core assembly.

Figure 5:
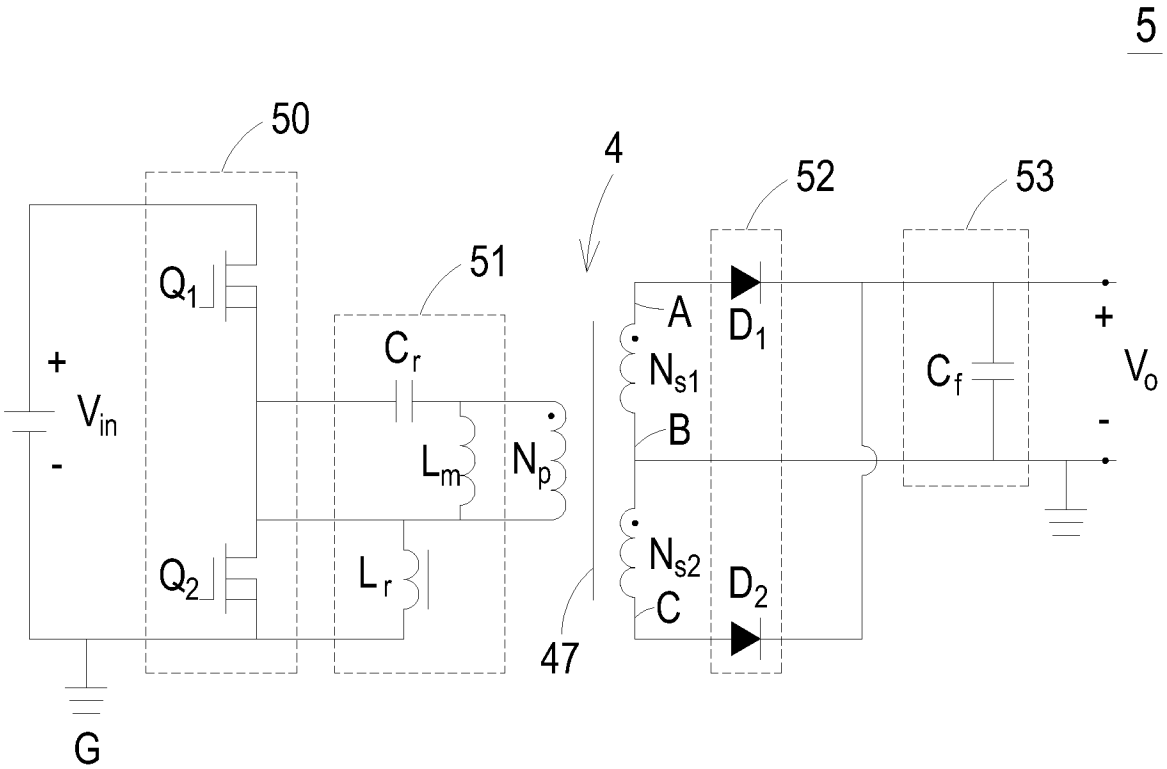
FIG. 5 shows the circuitry of the resonant converter employing the resonant transformer shown in FIG. 4A.

Referring to FIG. 5 in conjunction with FIG. 4A and FIG. 4B, in which FIG. 5 shows the circuitry of the resonant converter employing the resonant transformer shown in FIG. 4A. As shown in FIG. 5, the resonant converter 5 is a series resonant converter for converting an input voltage $V_{in}$ into an output DC voltage $V_o$ to drive a DC load. The DC load may be the light emitting diodes in a liquid crystal display. The resonant converter 5 includes a switch circuit 50, a resonant circuit 51, a resonant transformer 4, a rectifier 52, and a filter 53.

The switch circuit 50 is used to receive an input voltage $V_{in}$ and may include a plurality of switch elements, such as a first switch element $Q_1$ and a second switch element $Q_2$ being configured as a half-bridge switch circuit. However, the switch circuit 50 may have different configurations. In alternative embodiment, the switch circuit 50 may include four switch elements (not shown) being configured as a full-bridge switch circuit.

The resonant circuit 51 includes a resonant capacitor $C_r$, a resonant inductor $L_r$, and a magnetizing inductor $L_m$ that are connected in series with each other. One end of the resonant capacitor $C_r$ is connected between the first switch element $Q_1$ and the second switch element $Q_2$ of the switch circuit 50. The other end of the resonant capacitor $C_r$ is connected to one end of the magnetizing inductor $L_m$ and one end of an input winding $N_p$ of the resonant transformer 4. The magnetizing inductor $L_m$ may be made up of the equivalency of the input winding $N_p$ of the resonant transformer 4 which is connected in parallel with the input winding $N_p$. The other end of the magnetizing inductor $L_m$ is connected to one end of the resonant inductor $L_r$ and the other end of the input winding $N_p$. The magnetizing inductor $L_m$ is used to represent the equivalent inductive characteristics of the magnetizing inductance of the resonant transformer 4 when the input winding $N_p$ is operating. The other end of the resonant inductor $L_r$ is connected to a ground terminal G. The resonant inductor $L_r$ may be made up of the leakage inductance of the resonant transformer 4. By way of the resonant capacitor $C_r$, the resonant inductor $L_r$, and the magnetizing inductor $L_m$, the resonant circuit 51 produces resonance to allow the energy of the input voltage $V_{in}$ to be transferred to the input winding $N_p$ at the primary side of the resonant transformer 4 by the switching operations of the switch circuit 50. Furthermore, the energy of the input winding $N_p$ is transferred to the output windings at the secondary side of the resonant transformer 4 by the magnetic core assembly 47 in the manner of magnetic coupling.

In this embodiment, the configuration of the resonant transformer 4 is shown in FIG. 4A and FIG. 4B. Thus, the input winding $N_p$ at the primary side of the resonant transformer 4 can be made up of a first primary winding coil 42 and a second primary winding coil 45 connected with each other. The secondary side of the resonant transformer 4 includes a plurality of central-tapped output windings that are made up of a plurality of first secondary winding coils 43 and a plurality of second secondary winding coils 46. For example, as shown in FIG. 5, the secondary side of the resonant transformer 4 includes two output windings $N_{s1}$ and $N_{s2}$ that are made up of a plurality of first secondary winding coils 43 and a plurality of second secondary winding coils 46 connected with each other. The connecting configuration of the output windings is described as follows. The pins 415*a*, 416*a*, 445*a*, 446*a* corresponding to the terminals of a portion of the first secondary winding coils 43 and the terminals of a portions of the second secondary winding coils 46 are connected with each other with wires or traces, thereby constituting a terminal A of the output winding $N_{s1}$. The terminals of the remaining first secondary winding coils 43 and the terminals of the remaining second secondary winding coils 46 are connected with each other with wires or traces, thereby constituting a terminal C of the output winding $N_{s2}$. The other terminal of the first secondary winding coils 43 and the other terminal of the second secondary winding coils 46 are connected with each other with wires or traces, thereby constituting a center tap B consisted of the other terminal of the output winding $N_{s1}$ and the other terminal of the output winding $N_{s2}$. Moreover, the central tap B serves as the ground terminal for the output voltage $V_o$. In this way, the resonant transformer 4 can form the output windings $N_{s1}$ and $N_{s2}$ by a plurality of first secondary winding coils 43 and a plurality of second secondary winding coils 46. However, the resonant transformer 4 may have more than two output windings $N_{s1}$ and $N_{s2}$. The resonant transformer 4 can change the connecting configuration of the pins 415*a*, 416*a*, 445*a*, 446*a* with wires or traces depending on practical demands, so that the resonant transformer 4 can have three or more output windings that are connected with each other in a central-tapped manner. Thus, the resonant transformer 4 can output a plurality of output voltages with different voltage ratings.

The rectifier 52 is connected to the secondary side of the resonant transformer 4. In this embodiment, the rectifier 52 is connected to the output windings $N_{s1}$ and $N_{s2}$. The rectifier 52 includes a plurality of diodes, in which the number of the diodes is coherent with the number of the output windings. For example, the rectifier 52 includes a first diode $D_1$ and a second diode $D_2$. The anode of the first diode $D_1$ is connected to the positive dotted terminal of the output winding $N_{s1}$, i.e. the terminal A. The anode of the second diode $D_2$ is connected to the reverse dotted terminal of the output winding $N_{s2}$, i.e. the terminal C. The cathode of the first diode $D_1$ and the cathode of the second diode $D_2$ are connected to the filter 53 and constitute the high-voltage terminal of the output voltage $V_o$ together with the filter 53. The filter 53 is used for the purpose of filtration in order to output the output voltage $V_o$. The filter 53 may include a filtering capacitor $C_f$.

Moreover, the first side plate 413 and the second side plate 414 have a first coupling part 413*a* and a second coupling part 414*a*, respectively; and the third side plate 443 and the fourth side plate 444 have a third coupling part 443*a* and a fourth coupling part 444*a*, respectively. The first coupling part 413*a* and the third coupling part 443*a* have complementary structures, and the second coupling part 414*a* and the fourth coupling part 444*a* have complementary structures. In this embodiment, the first coupling part 413*a* and the fourth coupling part 444*a* are concave structures, and the second coupling part 414*a* and the third coupling part 443*a* are convex structures. When the third coupling part 443*a* and the fourth coupling part 444*a* are respectively engaged with the first coupling part 413*a* and the second coupling part 414*a*, the second bobbin 44 and the first bobbin 41 are combined together. It is noted that the numbers and configurations of the coupling parts may be varied as required.

Moreover, the first connecting base 415 and the second connecting base 416 of the first bobbin 41 have a first engaging part 415*c* and a second engaging part (not shown), respectively. Corresponding to the first engaging part 415*c* and the second engaging part, the third connecting base 445 and the fourth connecting base 446 have a third engaging part 445*c* and a fourth engaging part 446*c*, respectively. In this embodiment, the first engaging part 415*c* and the fourth engaging part 446*c* are concave structures, and the second engaging part and the third engaging part 445*c* are convex structures. When the third engaging part 445*c* and the fourth engaging part 446*c* are respectively engaged with the first engaging part 415*c* and the second engaging part, the second bobbin 44 and the first bobbin 41 are securely combined together. It is noted that the numbers and configurations of the engaging parts may be varied as required.

Please refer to FIG. 4A again. In views of cost-effectiveness, the first bobbin 41 and the second bobbin 44 are modular bobbins. That is, the first coupling part 413*a* of the first bobbin 41 and the fourth coupling part 444*a* of the second bobbin 44 have the same configurations, and the second coupling part 414*a* of the first bobbin 41 and the third coupling part 443 of the second bobbin 44 have the same configurations. In addition, the first engaging part 415*c* of the first bobbin 41 and fourth connecting base 446 of the second bobbin 44 have the same configurations, and the second engaging part of the first bobbin 41 and third engaging part 445*c* of the second bobbin 44 have the same configurations. Since the first bobbin 41 and the second bobbin 44 have the same configurations, the manufacture could produce one kind of bobbin without the need of designing various bobbins. In other words, the transformer 4 is very cost-effective.

FIG. 4B is a schematic assembled view illustrating the resonant transformer of FIG. 4A. Hereinafter, a process of assembling the resonant transformer 4 will be illustrated with reference to FIGS. 4A and 4B. First of all, the first primary winding coil 42 and the first secondary winding coils 43 are respectively wound around the first winding section 417 and the second winding sections 418 of the first bobbin 41, and the second primary winding coil 45 and the second secondary winding coils 46 are respectively wound around the third winding section 447 and the fourth winding sections 448 of the second bobbin 44. Then, the terminal 42*a* of the first primary winding coil 42 and the terminal 45*b* of the second primary winding coil 45 are fixed on the first pin 419*a*, and the terminal 42*b* of the first primary winding coil 42 and the terminal 45*a* of the second primary winding coil 45 are fixed on the second pin 419*b*. As such, the first primary winding coil 42 and the second primary winding coil 45 are connected with each other. Next, the terminals of the first secondary winding coils 43 and the second secondary winding coils 46 are fixed on the pins 415*a*, 416*a*, 445*a* and 446*a* of the first connecting base 415, the second connecting base 416, the third connecting base 445 and the fourth connecting base 446.

Then, the first leg portion 471*a* of the first magnetic part 471 and the first leg portion 472*a* of the second magnetic part 472 are embedded into the first channel 411 of the first bobbin 41, and the second leg portions 471*b* and 472*b* are respectively embedded into the second channel 444 of the second bobbin 44. At the same time, the first magnetic part 471 that is exposed outside the first bobbin 41 and the second bobbin 44 is supported on the first surface 415*b* of the first connecting base 415 and the third surface 445*b* of the third connecting base 445, and the second magnetic part 472 that is exposed outside the first bobbin 41 and the second bobbin 44 is supported on the second surface 416*b* of the second connecting base 416 and the fourth surface 446*b* of the fourth connecting base 446. The resulting structure of the resonant transformer 4 is shown in FIG. 4B. Since plural modular bobbins could be connected with each other in parallel to assemble the resonant transformer 4, the output voltage of the resonant transformer 4 is increased. It is noted that, however, those skilled in the art will readily observe that numerous modifications and alterations may be made while retaining the teachings of the invention. For example, if three modular bobbins are connected with each other in parallel, an EE-type core assembly is used to assemble the resonant transformer of the present invention.

Figure 1:
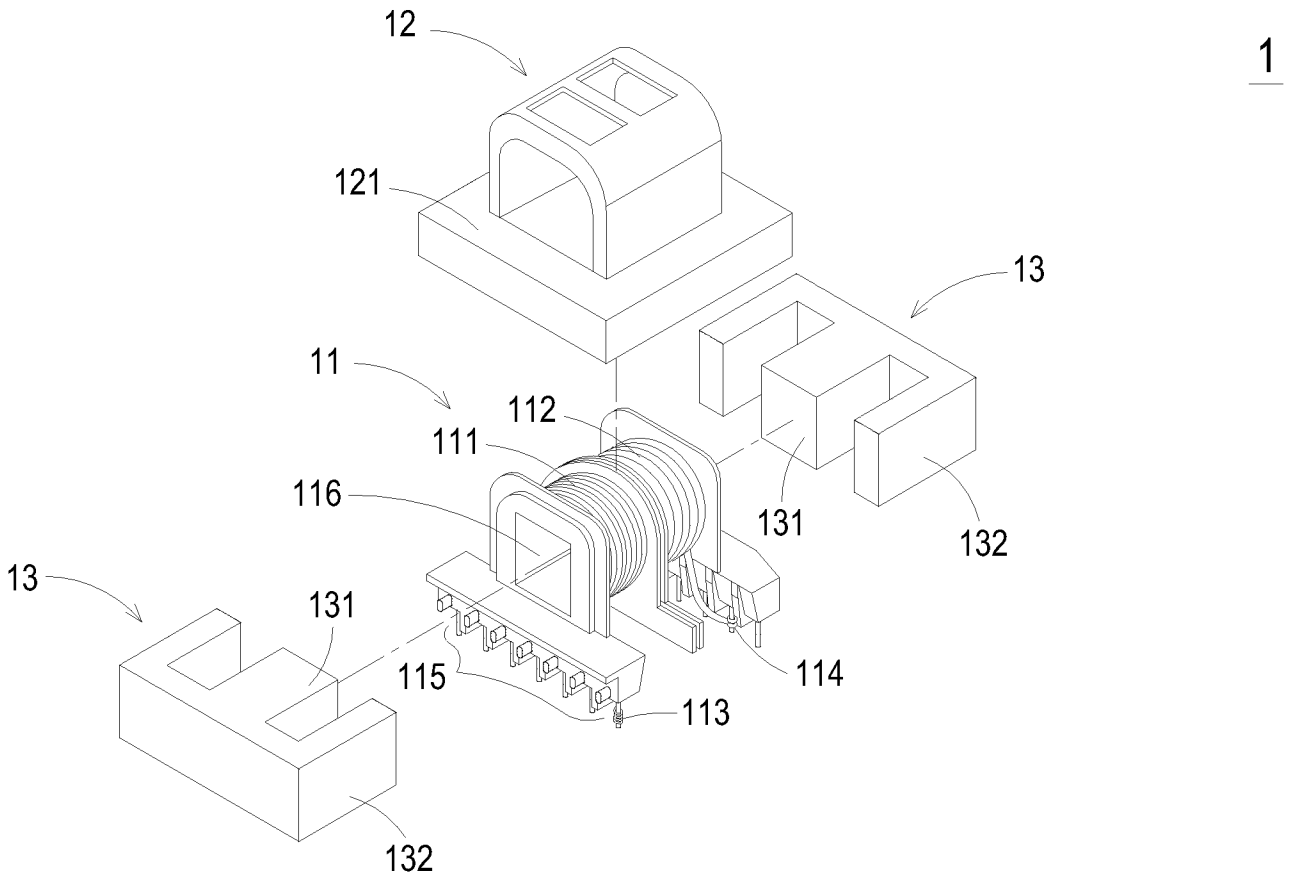
FIG. 1 PRIOR ART
FIG. 1 is a schematic exploded view of a conventional transformer.

The resonant transformer 4 is an assembly of the first bobbin 41, the second bobbin 44 and the magnetic core assembly 47 so that the first primary winding coil 42, the first secondary winding coils 43, the second primary winding coil 45 and the second secondary winding coils 46 can be wound around the first winding section 417, the single-trough second winding section 418, the third winding section 447 and the single-trough fourth winding section 448, respectively. Since the terminals 42*a* and 42*b* of the first primary winding coil 42 and the terminals 45*b* and 45*a* of the second primary winding coil 45 are wound around the first pin 419*a* and the second pin 419*b*, the winding space of the first winding section 417 and the third winding section 447 are increased. In other words, since the turn number of the first primary winding coil 42 wound around the first winding section 417 and the turn number of the second primary winding coil 45 wound around the third winding section 447 are increased, the electric conversion efficiency is enhanced. The resonant transformer 4 of the present invention has a maximum power output of 400 Watts, which is equal to the power output of four traditional transformers as shown in FIG. 1. Namely, comparing with one of the traditional transformer as shown in FIG. 1, the resonant transformer 4 of the present invention has at least four times power output. Due to that the resonant transformer 4 includes two bobbins and a magnetic core assembly but the four traditional transformers include four set of bobbins and four set of magnetic core assemblies, the manufacturing cost of the resonant converter is reduced when four traditional transformers are replaced with the resonant transformer 4 of the present invention.

In an embodiment, the creepage distances between the first primary winding coil 42 and the first secondary winding coil 43 and the creepage distances between the second primary winding coil 45 and the second secondary winding coil 46 are no less than 6 mm.

From the above description, since the first secondary winding coils and the second secondary winding coils are wound around respective single-trough second winding sections of the first bobbin and respective single-trough fourth winding sections of the second bobbin, the resonant transformer of the present invention has enhanced electric conversion efficiency and less usage of bobbin and magnetic core if comparing with using four traditional transformers as shown in FIG. 1. Since the terminals of the primary winding coil are fixed on the pins at the first winding section of the bobbin, the winding space of the first winding section is increased and the heat generated during operation of the resonant transformer is reduced. Moreover, since the single-trough second winding sections are arranged at bilateral sides of the first winding section, the air gap defined by the magnetic core assembly is disposed over the primary winding coil. Under this circumstance, the leakage inductance of the resonant transformer could be stably controlled, and the overall volume of the transformer is reduced. Moreover, since plural modular bobbins could be connected with each other in parallel to assemble the resonant transformer, the output voltage of the resonant transformer is increased, the utilization flexibility is increased, and the fabricating cost is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A resonant transformer comprising:

a first bobbin comprising a first main body and a first channel running through said first main body, wherein said first main body comprises a first winding section and plural single-trough second winding sections, plural pins are arranged at said first winding section, and said single-trough second winding sections are arranged at bilateral sides of said first winding section;

a first primary winding coil wound around said first winding section of said first bobbin, and connected with said pins at said first winding section;

plural first secondary winding coils wound around respective single-trough second winding sections of said first bobbin;

a second bobbin comprising a second main body and a second channel running through said second main body, wherein said second main body comprises a third winding section and plural single-trough fourth winding sections, and said single-trough fourth winding sections are arranged at bilateral sides of said third winding section;

a second primary winding coil wound around said third winding section of said second bobbin, and connected with said pins at said first winding section of said first bobbin;

plural second secondary winding coils wound around respective single-trough fourth winding sections of said second bobbin; and a magnetic core assembly partially embedded into said first channel of said first bobbin and said second channel of said second bobbin;

wherein said first bobbin further comprises:

a first side plate and a second side plate disposed on two opposite sides of said first main body; and plural partition plates disposed on said first main body and arranged between said first side plate and said second side plate;

wherein said first winding section and said single-trough second winding sections are defined by said partition plates, said first side plate and said second side plate;

wherein said second bobbin further comprises:

a third side plate and a fourth side plate disposed on two opposite sides of said second main body; and plural partition plates disposed on said second main body and arranged between said third side plate and said fourth side plate;

wherein said third winding section and said single-trough fourth winding sections are defined by said partition plates, said third side plate and said fourth side plate;

wherein a first connecting base and a second connecting base are respectively extended from said first side plate and said second side plate, and plural additional pins are extended from said first connecting base and said second connecting base to be connected with a plurality of terminals of said first secondary winding coils; and wherein a third connecting base and a fourth connecting base are respectively extended from said third side plate and said fourth side plate, and plural additional pins are extended from said third connecting base and said fourth connecting base to be connected with a plurality of terminals of said second secondary winding coils.

2. The resonant transformer according to claim 1 wherein said first winding section of said first bobbin is a single-trough winding section or a multi-trough winding section, and said third winding section of said second bobbin is a single-trough winding section or a multi-trough winding section.

3. The resonant transformer according to claim 1 wherein a portion of said pins disposed on said first connecting base, said second connecting base, said third connecting base and said fourth connecting base are connected with each other so that said first secondary winding coils and said second secondary winding coils are connected to form a plurality of output windings.

4. The resonant transformer according to claim 3 wherein said output windings are connected with each other in a central-tapped manner.

5. The resonant transformer according to claim 1 wherein said magnetic core assembly comprises a first magnetic part and a second magnetic part, each of said first magnetic part and said second magnetic part comprises a first leg portion and a second leg portion, and said first leg portion is embedded into said first channel of said first bobbin and said second leg portion is embedded into said second channel of said second bobbin.

6. The resonant transformer according to claim 1 wherein said first bobbin and said second bobbin have the same configurations.

7. The resonant transformer according to claim 1 wherein said first bobbin has a first coupling part and a second coupling part, and said second bobbin has a third coupling part and a fourth coupling part to be respectively engaged with said first coupling part and said second coupling part.

8. The resonant transformer according to claim 7 wherein said first coupling part and said fourth coupling part are convex structures, and said second coupling part and said third coupling part are concave structures.

9. The resonant transformer according to claim 1 wherein said first bobbin has a first engaging part and a second engaging part, and said second bobbin has a third engaging part and a fourth engaging part to be respectively engaged with said first engaging part and said second engaging part.

10. The resonant transformer according to claim 9 wherein said first engaging part and said fourth engaging part are concave structures, and said second engaging part and said third engaging part are convex structures.

* * * * *